US008196706B2

(12) United States Patent
Gunacker et al.

(10) Patent No.: US 8,196,706 B2
(45) Date of Patent: Jun. 12, 2012

(54) DEVICE FOR THE APPLICATION OF LUBRICANT ONTO THE RUNNING SURFACE OF RAILS FOR RAIL VEHICLES

(75) Inventors: Christian Gunacker, Vienna (AT); Bernhard Nowak, Vienna (AT)

(73) Assignee: Richard Gunacker, Tullnerbach (AT)

( * ) Notice: Subject to any disclaimer, the term of this patent is extended or adjusted under 35 U.S.C. 154(b) by 399 days.

(21) Appl. No.: 12/337,091

(22) Filed: Dec. 17, 2008

(65) Prior Publication Data

US 2009/0095570 A1 Apr. 16, 2009

Related U.S. Application Data

(60) Provisional application No. 61/014,581, filed on Dec. 18, 2007.

(51) Int. Cl.
*B61K 3/00* (2006.01)
*F16N 21/00* (2006.01)
*F16N 7/34* (2006.01)

(52) U.S. Cl. ..... 184/3.1; 184/50.2; 184/55.1

(58) Field of Classification Search ..... 184/3.1, 184/3.2, 6.23, 6.26, 7.3, 15.3, 50.2, 55.1, 184/55.2, 57; 118/629; 239/403, 694, 398, 239/380, 390, 461, 690, 704; 222/133
See application file for complete search history.

(56) References Cited

U.S. PATENT DOCUMENTS

| | | | | |
|---|---|---|---|---|
| 3,059,724 | A | 10/1962 | Soule | |
| 4,214,647 | A * | 7/1980 | Lutts | 184/3.1 |
| 4,232,824 | A * | 11/1980 | Binoche | 239/8 |
| 4,477,023 | A * | 10/1984 | Gates | 239/340 |
| 4,528,782 | A * | 7/1985 | Bean | 451/102 |
| 4,834,218 | A * | 5/1989 | Dombroski et al. | 184/3.1 |
| 4,856,617 | A * | 8/1989 | Lounsberry et al. | 184/3.1 |
| 5,158,694 | A * | 10/1992 | Waynick | 508/163 |
| 5,873,530 | A * | 2/1999 | Chizinsky | 239/318 |
| 6,578,669 | B2 * | 6/2003 | Kast et al. | 184/3.2 |
| 6,971,479 | B1 | 12/2005 | Urmson, Jr. et al. | |
| 6,991,065 | B2 * | 1/2006 | Leslie et al. | 184/2 |
| 7,096,997 | B2 * | 8/2006 | Appleby et al. | 184/3.1 |
| 2003/0111295 | A1 * | 6/2003 | Kumar et al. | 184/3.1 |
| 2005/0285408 | A1 * | 12/2005 | Eadie et al. | 291/3 |
| 2006/0163004 | A1 * | 7/2006 | Kumar | 184/3.1 |

FOREIGN PATENT DOCUMENTS

| | | |
|---|---|---|
| EP | 1 683 699 A2 | 7/2006 |
| JP | 2002-037068 A | 2/2002 |

* cited by examiner

*Primary Examiner* — Michael Mansen
*Assistant Examiner* — Minh Truong
(74) *Attorney, Agent, or Firm* — Henry M. Feiereisen; Ursula B. Day

(57) ABSTRACT

A device for the application of lubricant onto the running surface of rails for rail vehicles includes at least one dispensing nozzle for issuing out a lubricant, and an air nozzle provided above the dispensing nozzle and aligned to blow out air in a direction of an upper edge of the dispensing nozzle and a railhead. The dispensing nozzle extends upwardly on an outer railhead surface which is distal to a contact surface for a rim of a running wheel of the rail vehicle.

16 Claims, 3 Drawing Sheets

DEVICE FOR THE APPLICATION OF LUBRICANT ONTO THE RUNNING SURFACE OF RAILS FOR RAIL VEHICLES

CROSS-REFERENCES TO RELATED APPLICATIONS

This application claims the benefit of prior filed U.S. provisional Application No. 61/014,581, filed Dec. 18, 2007, pursuant to 35 U.S.C. 119(e).

BACKGROUND OF THE INVENTION

The present invention relates to a device for the application of lubricant onto the running surface of rails of rail vehicles.

Nothing in the following discussion of the state of the art is to be construed as an admission of prior art.

Screeching noises and accompanying wearing and/or fluting of a rail are encountered, when slippage of the running wheels of the rigid axle of the rail vehicle is caused in particular, when the rail vehicle negotiates a curved track. To address this problem, one approach suggests to force lubricant from below via angled bores through the rail up to the railhead from where the running wheels of the rail vehicles are able to sweep up lubricate and distribute it across the railhead. This approach causes, however, a weakening in the static of the railhead and has thus been rejected by operators of railroad networks. Another approach involves the application of lubricant by means of a lubricant dispensing nozzle which is placed on a side of the railhead. A pump forces lubricant from a storage container from the side to the railhead upwards far enough to allow the running wheel of the rail vehicle to sweep up the lubricant and to distribute it across the running surface of the railhead. This approach has the drawback that the lubricant amount is not easy to meter, so that loss and environmental stress is experienced, on one hand, and the application of excessive amounts of lubricant cannot be avoided, on the other hand, resulting in a decrease in traction and thus also in the gripping ability during braking. Further, the buildup of the lubricant bead at the site of application is dependent on the viscosity of the lubricant. The viscosity of the lubricant, in turn, is dependent on the lubricant temperature as well as the rail temperature so that lubricant may escape to the side before the running wheel is able to sweep it up, when the temperatures are elevated and thus the viscosities are lower.

It would therefore be desirable and advantageous to provide an improved lubricant application device which obviates prior art shortcomings and which dispenses lubricant in controlled doses to substantially prevent lubricant loss and resultant damage to the environment, and in particular to prevent a decrease in the grip of the wheels on the rail running surface.

SUMMARY OF THE INVENTION

According to one aspect of the present invention, a device for the application of lubricant onto the running surface of a rail for a rail vehicle includes at least one dispensing nozzle for issuing out a lubricant, wherein the dispensing nozzle extends upwardly on an outer railhead surface which is distal to a contact surface for a rim of a running wheel of the rail vehicle, and an air nozzle provided above the dispensing nozzle and aligned to blow out air in a direction of an upper edge of the dispensing nozzle and the railhead.

The present invention resolves prior art problems by providing an air nozzle above the dispensing nozzle and aligning the air nozzle to blow out air toward the upper edge of the dispensing nozzle and the railhead. As a result, only a small amount of lubricant is dispensed by the dispensing nozzle upon the upper rounded edge of the side flank of the railhead, and the lubricant is then forced by air blown out by the air nozzle to flow via the upper rounded edge of the railhead and across the running surface of the railhead in the form of a film.

According to another feature of the present invention, the air nozzle may be arranged horizontally or adjustably so as to be directed upwards in relation to the horizontal by up to 100. The adjustability of the orientation of the air nozzle has the advantage that the blow air jet exiting the air nozzle pushes the applied lubricant in an optimal manner over the upper rounded edge of the side flank of the railhead and is able to distribute the lubricant across the running surface of the railhead, i.e. the blow air jet acts upon the lubricant issuing out of the dispensing orifice of the lubricant dispensing nozzle, without lubricant running off unused.

According to another feature of the present invention, the air nozzle can be a flat jet nozzle or an angular nozzle. A flat jet nozzle has the advantage that the blow air jet acting on the lubricant is broad in relation to the width of the lubricant immediately after the dispensing orifice of the lubricant dispensing nozzle to thereby evenly distribute the lubricant as thin film across the running surface of the railhead. A spot-shaped blow air jet would only distribute the lubricant in the impact zone, instead of forming an even and thin lubricant film, and would cause lubricant to squirt away in the adjacent zone, when a sharply pointed jet impacts, so that the rail running surface would not be reached.

Implementation of the air nozzle in the form of an angular nozzle has the advantage that the device becomes compact and projects to a lesser degree out to the side.

The configuration of the air nozzle of the present application depends firstly on the orientation of the air nozzle and secondly on the disposition of the air nozzle in relation to the lubricant dispensing nozzle. The precise configuration of the air nozzle is selected in such a way that virtually the entire blow air jet acts on the lubricant.

According to another feature of the present invention, a process controller may be provided for the application of a defined lubricant amount to be dispensed by the dispensing nozzle. The process controller may hereby be constructed for the transformation of one or more process input variables into control output signals for the lubricant amount and the air quantity and/or pressure for the blow air. This individual control of the components provides, compared to conventional proposals, the advantage that the lubricant amount can be metered, on one hand, and the quantity as well as the pressure of the blow air responsible for the distribution of the lubricant across the running surface of the railhead can be controlled.

According to another feature of the present invention, the process input variables can be parameters which impact the viscosity of the lubricant, such as lubricant temperature and rail temperature. Furthermore, the process output variables may be the lubricant amount, the pressure and the quantity of the blow air and/or length of time of blow exposure. The viscosity and thus the flow properties of the lubricant depend also on the temperature. In general, the lubricant becomes more liquid as the temperature rises. As a result, less lubricant has to be applied upon the railhead when the lubricant has a lower viscosity and thus a smaller quantity of blow air and/or smaller blow air pressure is required to force the lubricant over the upper rounded edge of the flank of the railhead and to then distribute it across the running surface of the railhead.

According to another feature of the present invention, the pressure of the blow air may be selected in a range of 5 to 8 bar, wherein a higher pressure of the blow air is required, when the lubricant is more viscous.

Examples of lubricant for use with the device of the present application generally include synthetic lubricating grease, thickeners, metal additives, and sulfates. Currently preferred is a selection of the lubricant according to the viscosity grades (according to NLGI) of 000 to 3. The selection of the viscosity grade of the lubricant varies depending on the application and climate conditions.

According to another feature of the present invention, the supply of blow air and the supply of lubricant may be controlled via electric or pneumatic control valves. The use of electric or pneumatic control valves has the advantage that the control of the device can not only be configured in a simple manner but can be rendered operative in response to the respective signals without substantial time delay in relation to the lubricant issuance and/or length of time to blow exposure.

According to another feature of the present invention, the application cycle, comprised of lubricant application, pressure application, and distribution across the railhead, can be triggered by a probe responsive to the characteristic noise generation, preferably an oscillation/frequency sensor, like, for example, an audio microphone. This embodiment has the advantage that lubricant is applied onto the track body, in particular curved tracks, only when the presence of the characteristic "screeching" signals that the amount of lubricant applied onto the track body is too small. As an alternative, the application cycle, comprised of lubricant application, pressure application, and distribution across the railhead, may also be triggered by a counting device which sends a pulse to the process control unit, when a predefined number of trains has been exceeded.

The device according to the invention may be attached at any point of the track body, including curved tracks where wear and characteristic fluting of the rail surface are primarily experienced. Of course, any number of devices according to the invention may be installed on the track body, whereby the selection depends on factors such as environmental conditions, the frequency of the rail vehicles, the length of the train, etc. The lubricant amount is evenly distributed to the individual units by means of lubricant feed tubes of same length and same inner diameter.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 2:
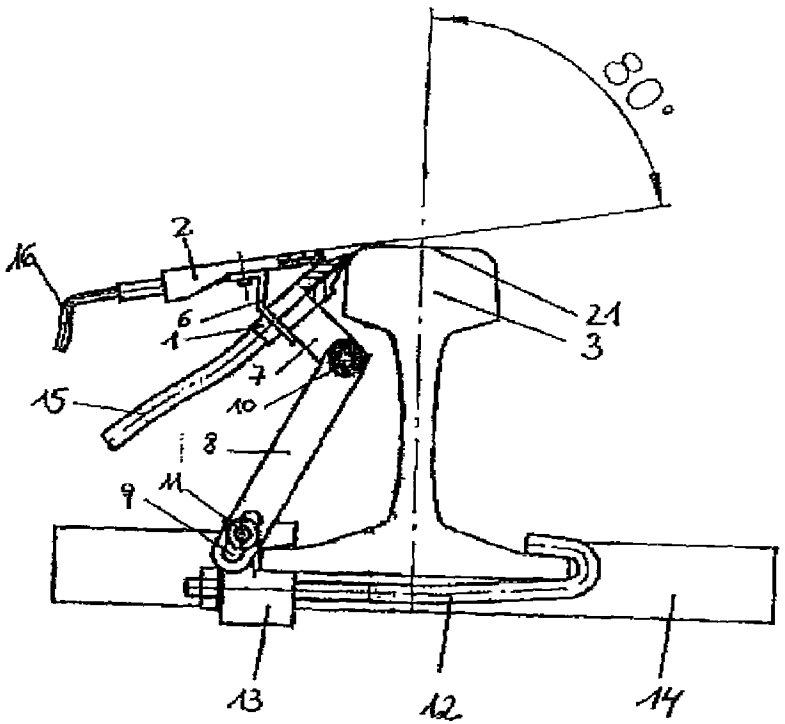
FIG. 2 is a schematic illustration of a lubricant application device according to the present invention mounted to a rail, depicting a blow air nozzle in 10° upwardly directed orientation in relation to the horizontal.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1:
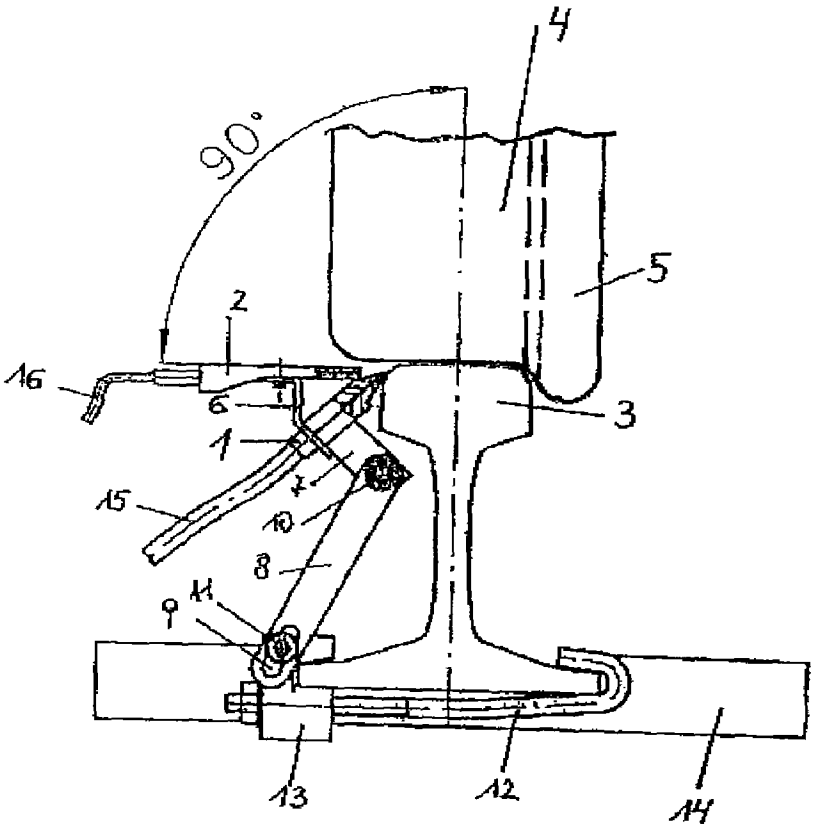
FIG. 1 is a schematic illustration of a lubricant application device mounted to a rail, depicting a blow air nozzle in horizontal orientation.

Turning now to the drawing, and in particular to FIG. 1, there is shown a schematic illustration of a lubricant application device according to the present invention, including a lubricant dispensing nozzle 1 which is directed onto the upper rounded edge of the flank of the railhead 3, and a blow air nozzle 2 which is arranged above the lubricant dispensing nozzle 1 either horizontal (FIG. 1) or upwardly directed by up to 10° in relation to the horizontal (FIG. 2). The lubricant dispensing nozzle 1 and the blow air nozzle 2 are arranged on the rail side which faces away from the rim 5 of the running wheel 4. The lubricant dispensing nozzle 1 is rotatably secured by a dispensing nozzle mounting 7 via a hinge 10 to a holding element 8 which includes an oblong hole 9 and, in turn, is secured via a hinge 11 to the clamping piece 13 of a rail mount 12. The clamping piece 13 together with the rail mount 12 secures the rail on the tie 14. The blow air nozzle 2 is held in place in relation to the lubricant dispensing nozzle 1 by an air nozzle mounting 6 which is secured to the lubricant dispensing nozzle 1. Lubricant 17 as well as blow air 19 is supplied to the nozzles 1, 2 via respective feed lines 15, 16. The lubricant dispensing nozzle 1 and the blow air nozzle 2 may be positioned in optimal relationship to the upper rounded edge of the railhead 3 by means of both hinges 10, 11 and the oblong hole 9 located in the holding element 8, with the lubricant dispensing nozzle 1 resting against the railhead 3 at the lubricant dispensing site 18.

Figure 3:
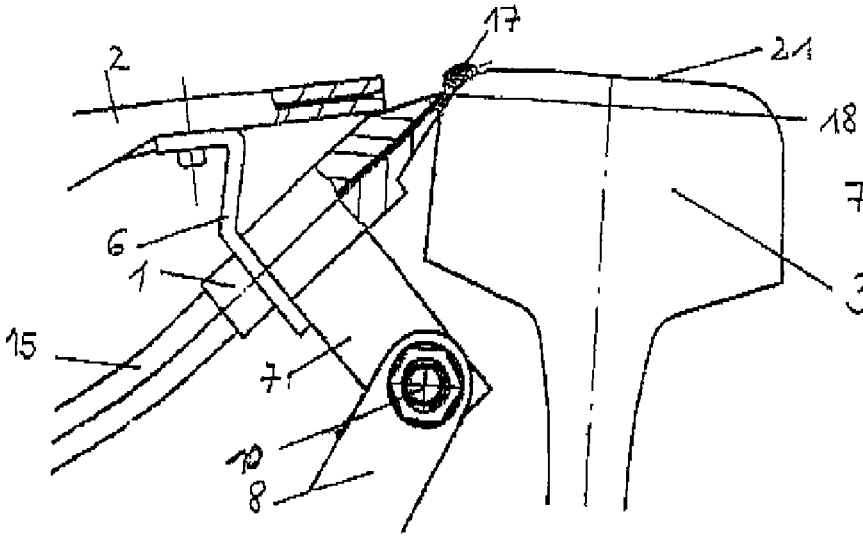
FIG. 3 is a schematic illustration of a lubricant application device according to the present invention, when lubricant issues out of a lubricant dispensing nozzle onto the upper rounded edge of the flank of the railhead.
Figure 4:
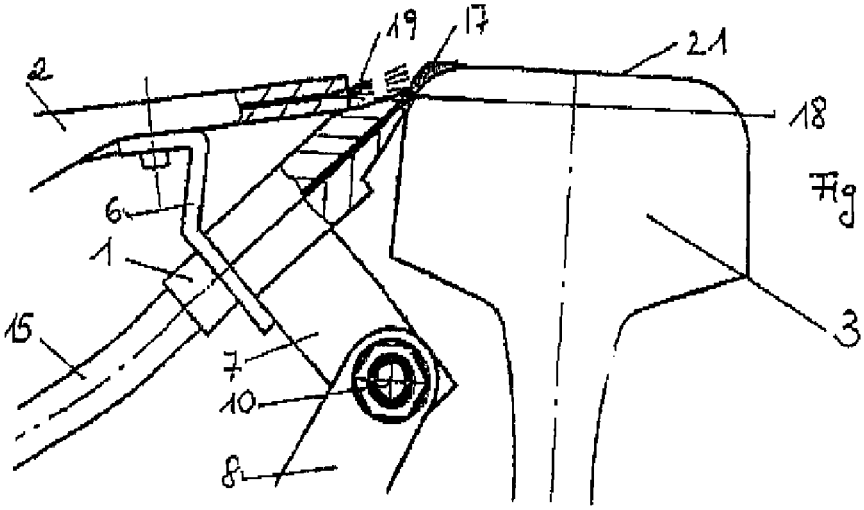
FIG. 4 is a schematic illustration of the lubricant application device, when blow air applied by the air nozzle begins to act on the lubricant.
Figure 5:
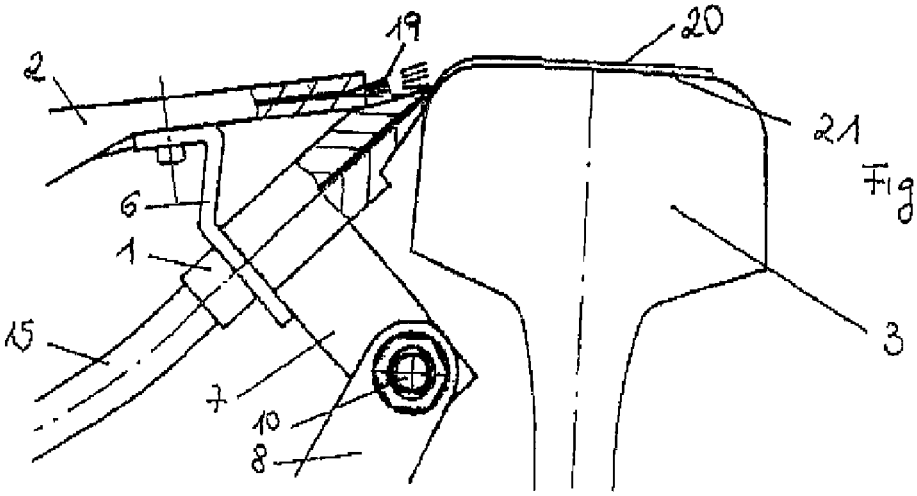
FIG. 5 is a schematic illustration of the lubricant application device, when the blow air causes distribution of a thin lubricant film across the railhead.

The lubricant 17 is conveyed from a lubricant reservoir by a pump via the lubricant feed line 15 to the lubricant dispensing nozzle 1 and issues out at the lubricant dispensing site 18 (FIG. 3). The lubricant amount is controlled on the basis of the conveying capacity and pumping time, wherein the lubricant amount is determined, if need be, by a process controller 30 in dependence on the rail temperature and/or lubricant temperature, as shown by way of example in FIG. 6. In the next step, a pneumatic control valve V causes blow air 19 to be conducted via the blow air feed line 16 to the blow air nozzle 2 for the blow air 19 to force lubricant 17, issuing out at the lubricant dispensing site 18 at the upper edge of the nozzle 1, over the upper rounded edge of the railhead 3 (FIG. 4). The flat jet of blow air then evenly distributes lubricant 17 evenly across the running surface 21 of the railhead 3 to establish a thin lubricant film 20 (FIG. 5). After the lubricant 17 has been distributed, the pneumatic control valve V cuts the supply of blow air and the lubricant 17 is then further distributed by the running wheels 4 of the rail vehicles, wherein the blowing time is ascertained and adjusted by the process controller 30 on the basis of the pressure of the blow air, rail and lubricant temperatures. Hence, an application cycle has concluded.

Figure 6:
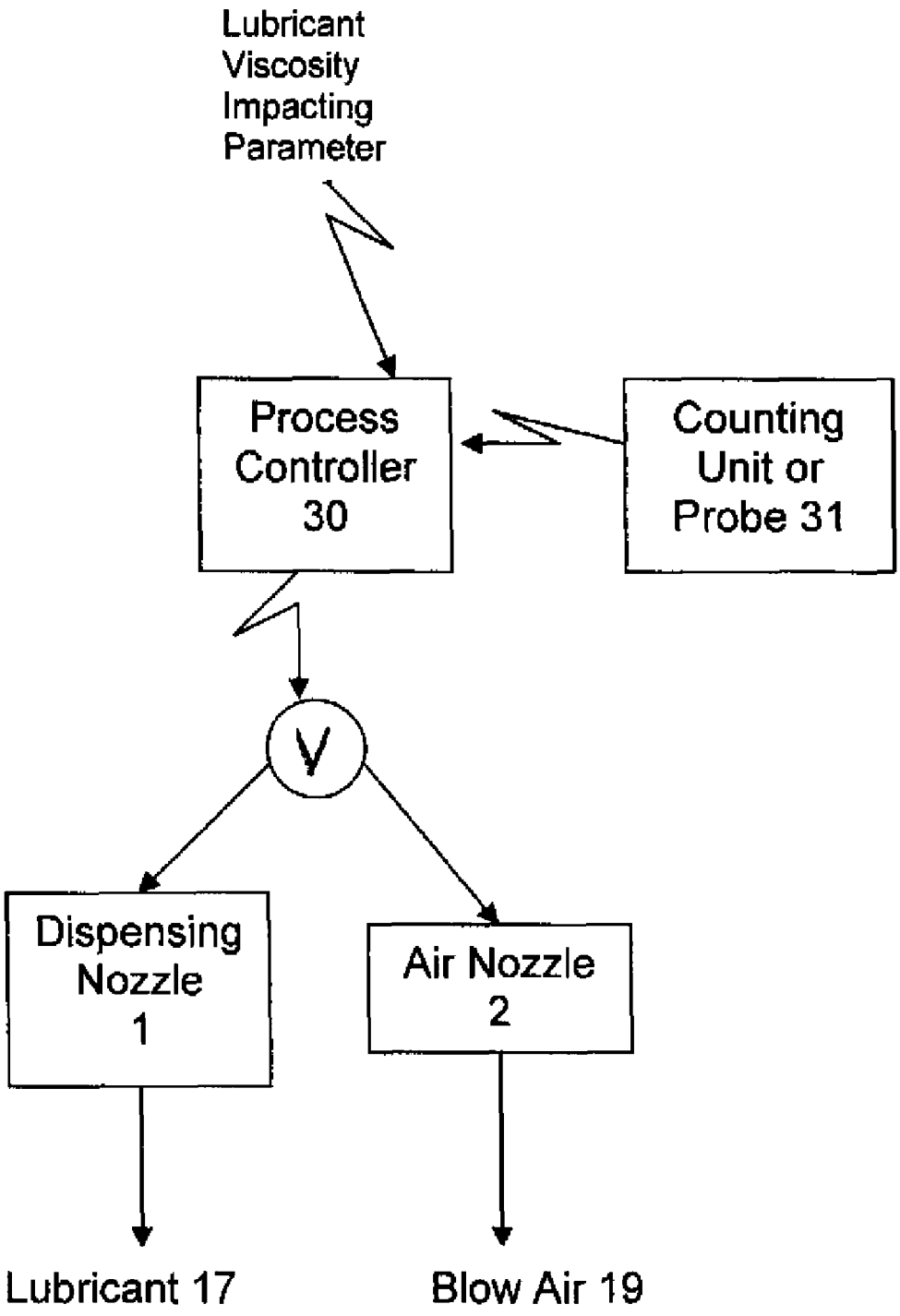
FIG. 6 is a block diagram showing the relationship and operation of the components of the lubricant application device.

A new application cycle is then triggered, for example, by a probe 31, e.g. an audio microphone which senses the characteristic "screeching" of the rail vehicle, or by a counting unit 31 which counts the number of passing wheels, by transmitting a respective signal to a process controller 30 (FIG. 6).

When a new application cycle is triggered, an amount of lubricant 17, predefined on the basis of viscosity, is dispensed by the lubricant dispensing nozzle 1 onto the upper rounded edge of the railhead 3 and, depending on the viscosity of the lubricant 17, is exposed to blow air for 1 to 2 seconds at a pressure of 5 to 8 bar in order to evenly distribute the lubricant 17 across the running surface of the railhead. The required air quantity ranges hereby from 8 to 20 liters/second.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A device for the application of lubricant onto the running surface of a rail for a rail vehicle, comprising:

at least one dispensing nozzle for issuing out a lubricant onto a railhead of the rail, said dispensing nozzle extending upwardly on an outer railhead surface which is distal to a contact surface for a rim of a running wheel of the rail vehicle; and an air nozzle provided above the dispensing nozzle and aligned to blow out air in a direction to the upper edge of the dispensing nozzle and the railhead to distribute lubricant applied by the dispensing nozzle across the railhead.

2. The device of claim 1, wherein the air nozzle is arranged horizontally.

3. The device of claim 1, wherein the air nozzle is adjustably arranged upwards at an angle in a range of up to 10° in relation to the horizontal.

4. The device of claim 1, wherein the air nozzle is a flat jet nozzle.

5. The device of claim 1, further comprising a process controller operatively connected to the dispensing nozzle for controlling the dispensing nozzle to issue out a predefined amount of lubricant.

6. The device of claim 5, wherein the process controller is operatively connected to the air nozzle for controlling the air nozzle to blow out a predefined amount of blow air, said process controller being constructed to transform at least one input variable into an output signal for controlling the predefined amount of lubricant and a quantity and/or pressure of the blow air.

7. The device of claim 6, wherein the input variable is a parameter that impacts a viscosity of the lubricant.

8. The device of claim 7, wherein the parameter is a lubricant temperature or a rail temperature.

9. The device of claim 6, wherein the output signal is representative of at least one parameter selected from the group consisting of the lubricant amount, the pressure of the blow air, the quantity of blow air, and a length of time of blow air being blown at the lubricant.

10. The device of claim 9, wherein the pressure of the blow air ranges from 5 to 8 bar.

11. The device of claim 5, further comprising an electric or pneumatic valve assembly operatively connected to the process controller to make or cut a flow of the blow air to the air nozzle and/or a flow of lubricant to the dispensing nozzle supply.

12. The device of claim 5, further comprising a counting unit to trigger an application cycle, comprised of lubricant application, pressure application, and lubricant distribution across the railhead, said counting unit rendered operative to send a pulse to the process controller, when a predefined number of trains is exceeded.

13. The device of claim 1, wherein the lubricant has a viscosity grade of 000 to 3 according to the standards established by the National Lubrication Grease Institute.

14. The device of claim 1, further comprising a probe to trigger an application cycle, comprised of lubricant application, pressure application, and lubricant distribution across the railhead, said probe rendered operative in response to the generation of a characteristic noise.

15. The device of claim 14, wherein the probe is an oscillation/frequency sensor.

16. The device of claim 14, wherein the probe is an audio microphone.

* * * * *